United States Patent [19]

Mori et al.

[11] Patent Number: 4,486,284

[45] Date of Patent: Dec. 4, 1984

[54] METHOD OF ELECTRODEPOSITION COATING AND APPARATUS THEREFOR

[75] Inventors: Takanobu Mori; Yoshinobu Takahashi; Haruo Murase, all of Toyota, Japan

[73] Assignee: Toyota Jidosha Kabushiki Kaisha, Aichi, Japan

[21] Appl. No.: 445,712

[22] Filed: Nov. 30, 1982

[30] Foreign Application Priority Data

Nov. 30, 1981 [JP] Japan ..... 56-192658

[51] Int. Cl.[3] ..... C25D 13/00; C25D 13/18; C25D 13/22

[52] U.S. Cl. ..... 204/181 R; 204/300 EC

[58] Field of Search ..... 204/299 EC, 300 EC, 204/181 R, 181 C

[56] References Cited

U.S. PATENT DOCUMENTS

| | | | |
|---|---|---|---|
| 3,355,374 | 11/1967 | Brewer et al. | 204/181 R |
| 3,728,242 | 4/1973 | Loop et al. | 204/181 R |
| 3,730,866 | 5/1973 | Madejczyk | 204/181 R |
| 4,210,505 | 7/1980 | Todoroki et al. | 204/300 EC |

*Primary Examiner*—John F. Niebling
*Assistant Examiner*—B. J. Boggs, Jr.
*Attorney, Agent, or Firm*—Oblon, Fisher, Spivak, McClelland & Maier

[57] ABSTRACT

A method of electrodeposition coating and an apparatus therefor in which, while a work to be coated such as vehicle body is present in a conduction stage of low voltage and current flows to the work from the anode plate of said conduction stage of low voltage, current flows to the work also from the anode plate of a conduction stage of higher voltage to increase the thickness of a coating film and to attain thorough electrodeposition to the work.

4 Claims, 5 Drawing Figures

METHOD OF ELECTRODEPOSITION COATING AND APPARATUS THEREFOR

BACKGROUND OF THE INVENTION

1. Field of the Invention

This invention relates to a method and apparatus of electrodeposition coating of vehicle bodies or the like, and more specifically to a method and apparatus of multistage power conduction in cationic electrodeposition coating.

2. Description of the Prior Art

According to the conventional multi-stage power conduction method which has been employed in the electrodeposition coating, a power supply including an AC power transformer and a rectifier is independently provided for each conduction stage. In conduction stages which precede the final conduction stage located at the end in the direction of transfer of the work to be coated, a low voltage or a of gradually increasing voltage is applied for the purpose of preventing defects in the quality of the electrodeposited film, while a high voltage is applied in the final conduction stage at the end of transfer of the work in order to ensure a good coating of desired thickness of the electrodeposited film and a thorough electrodeposition thereof. However, the application of high voltage in the final conduction stage is normally feasible only for a short time due to limitation of the length and size of the electrodeposition bath, often resulting in degrading the coating in terms of thickness of the electrodeposition film and thorough electrodeposition.

On the other hand, if high voltage is applied in the first conduction stage in a single- or multi-stage conduction method for the purpose of ensuring the thickness and adhesion of the electrodeposited film and thorough electrodeposition, there occur rashes, pinholes or irregular steps on the coated film surface especially in the case of cationic electrodeposition coating, thereby failing to attain a desirable quality of the coating.

SUMMARY OF THE INVENTION

It is an object of the present invention to provide an improved method and apparatus of electrodeposition coating by means of multi-stage power conduction, in which a single power transformer is commonly used for the rectifiers of a plurality of conduction stages, permitting the current to flow into the work in a specific conduction stage from an electrode of a different conduction stage thereby to improve the thickness of the electrodeposition film and the thorough application to the body of electrodeposition.

It is another object of the invention to improve the quality of the film to be formed by adjusting the output voltage of the rectifier of a conduction stage in which a work is present and minimize the potential difference from the positive electrode of the succeeding conduction stage, namely, minimize the variation in potential while the work is transferred to the succeeding stage.

It is a further object of the invention to prevent dissolution of the electrodeposition bath wall even when the lining of the bath is broken during electrodeposition coating process by the multi-stage power conduction system.

In order to achieve the foregoing objectives, the present invention provides a method of multi-stage electrodeposition coating in which a plurality of conduction stages are provided along a path of transfer of a work in the electrodeposition bath, each conduction stage having a bus bar and an anode plate to apply different voltages to the work constituting a cathode. The work is transferred from a conduction stage of low voltage to a conduction stage of a higher voltage, characterized in that, while the work is present in the conduction stage of low voltage and current flows to the work from the anode plate of the low voltage conduction stage with current flowing to the work from the anode plate of the conduction stage of higher voltage. By adoption of this method, it becomes possible to increase the current flow to the work by the additional current from the other conduction stage for ensuring satisfactory thickness of coating film and thorough application to the body of electrodeposition. In this instance, the difference between the impressed voltage applied to the specific conduction stage from that of the succeeding conduction stage can be minimized by adjusting the voltage of the specific conduction stage, and thus the variation in voltage which the work undergoes during transfer between the two conduction stages may be minimized for the purpose of obtaining a coated product of high quality. In addition, dissolution of the electrodeposition bath wall can be prevented by maintaining the potential of the electrodeposition bath at the same level as the negative electrode of the conduction stage having the highest voltage.

According to the present invention, there is also provided an electrodeposition coating apparatus for carrying out the above-described method, including a plurality of conduction stages along a path of transfer of a work in an electrodeposition bath, each conduction stage having a bus bar and an anode plate to apply different voltages to the work each conduction stage constituting a cathode, and a power supply consisting of a power transformer and a rectifier having the positive and negative terminals connected to the anode plate and the bus bar respectively, characterized in that the electrodeposition apparatus comprises a plurality of rectifiers provided respectively for a plurality of conduction stages and connected to a single common power transformer. In this instance, the bus bars of adjacent conduction stages are disconnectibly connected through a conductor. With this arrangement, when the work is in the low voltage conduction stage, a closed current circuit is formed through the work and the anode plate of the high voltage conduction stage by the lead wire connecting the rectifier with the power transformer, permitting the current to flow to the work simultaneously from the anode plate of the high voltage conduction stage to enhance the efficiency of the electrodeposition coating, improving the thickness and thorough electrodeposition of the coating film. In this case, if the output voltage of the rectifier is adjustable, it becomes possible to minimize the variation in voltage while the work is transferred from one conduction stage to another one and to improve the quality of film.

Further, the bus bar of the conduction stage having the highest voltage and the electrodeposition bath are both grounded. Consequently, the electrodeposition bath is maintained at the lowest potential, preventing dissolution of the bath wall even if the lining of the bath is damaged.

BRIEF DESCRIPTION OF THE DRAWINGS

The above and other objects, features and advantages of the invention will become apparent and more readily appreciated from the following detailed description of a present preferred exemplary embodiment of the invention, taken in conjunction with the accompanying drawings, in which.

DETAILED DESCRIPTION OF THE INVENTION

The electrodeposition coating apparatus of the invention is described below in greater detail by way of a preferred embodiment with reference to FIGS. 1 and 3.

Figure 1:
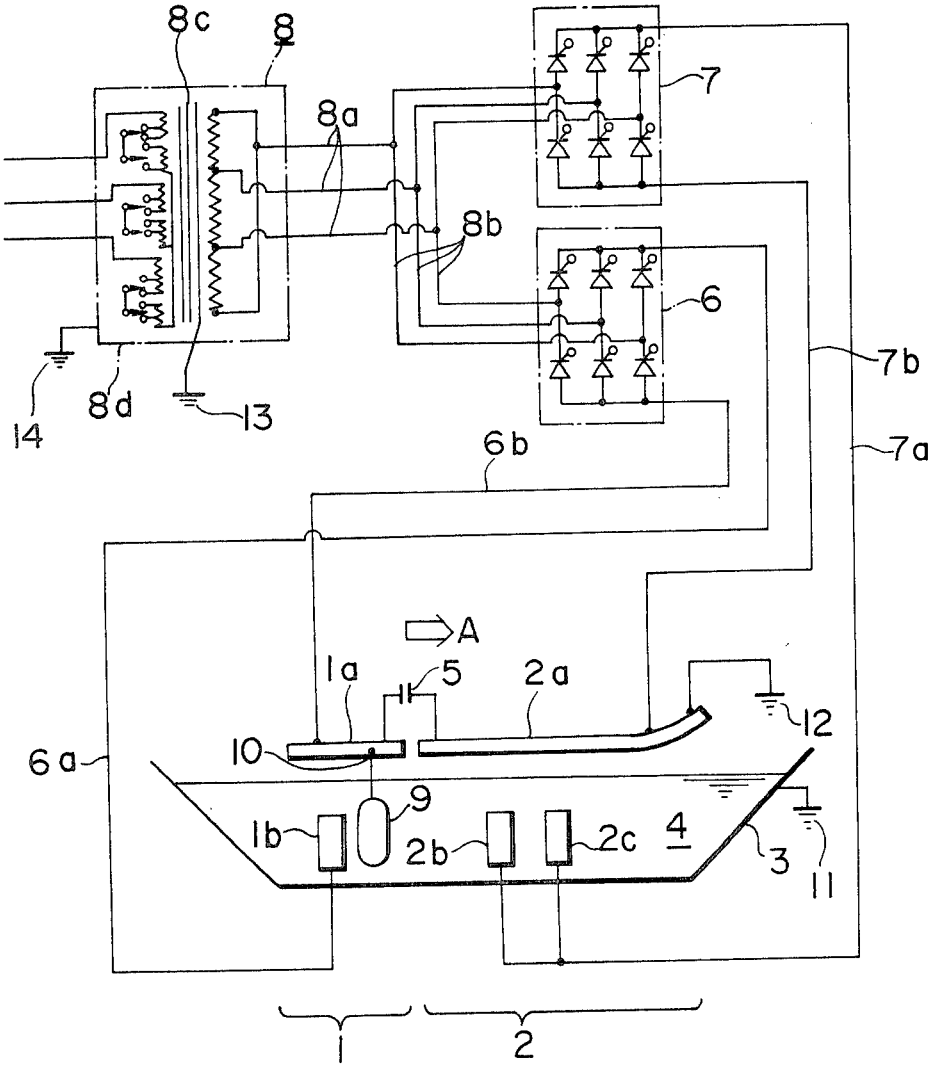
FIG. 1 is a circuit diagram of a two-stage power conduction system of the invention as employed for cationic electrodeposition coating.

Referring to FIG. 1, there is illustrated a two-stage power conduction system for cationic electrodeposition coating, which consists of a first conduction stage 1 for impression of a low voltage and a second conduction stage 2 for impression of a high voltage. The first conduction stage 1 includes a bus bar 1*a* which is located over an electrodeposition bath 3, and an anode 1*b* which is located within the electrodeposition bath 3. Similarly, the second conduction stage 2 includes a bus bar 2*a* which is located over the electrodeposition bath 3, and anode plates 2*b* and 2*c*. The electrodeposition bath 3 is filled with a paint 4, and grounded as indicated at 11. On the other hand, the bus bars 1*a* and 2*a* are connected with each other through a conductor 5. The bus bar 2*a* of the high voltage conduction stage 2 is grounded as indicated at 12.

The reference numeral 6 denotes a rectifier for the low voltage conduction stage 1, the rectifier 6 having its positive terminal connected to the anode plate 1*b* through lead wire 6*a* and its negative terminal to the bus bar 1*a* through lead wire 6*b*. Designated at 7 is a rectifier for the high voltage conduction stage 2, the rectifier 7 having its positive terminal connected parallel with anode plates 2*b* and 2*c* through lead wire 7*a* and its negative terminal to the bus bar 2*a* through lead wire 7*b*. These rectifiers 6 and 7 are connected to a common AC power transformer 8 through lead wires 8*a* and 8*b*. Consequently, the rectifiers 6 and 7 are connected with each other through lead wire 8*b*. As shown particularly in FIG. 1, the iron core 8*c* and casing 8*d* of the AC power transformer 8 are grounded as indicated at 13 and 14, respectively.

The reference numeral 9 denotes a work to be coated, for example, a vehicle body, which is held in sliding contact with the bus bars 1*a* and 2*a* through a collector 10.

The above-described apparatus is suitable for carrying out the method of electrodeposition coating according to the present invention, which will be discussed in greater detail hereinafter.

The work 9 is fed to ride onto the bus bar 1*a* of the first low voltage conduction stage 1, in a state completely or partially immersed in the paint 4 in the electrodeposition bath 3 or out of contact with the paint 4. At this time, the conductor 5 is still in an off-state, so that the rectifier 6 applies an output voltage of zero or low level to the first conduction stage 1 while the rectifier 7 applies a predetermined coating voltage (a high voltage of about 300V) to the second conduction stage 2.

The transfer of the work 9 onto the bus bar 1*a* is detected by a limit switch (not shown) or a photoelectric tube (not shown), whereupon the output voltage of the rectifier 6 is gradually increased and current flows to the work 9 from the anode plate 1*b* to effect the electrodeposition coating. At this time, a high voltage is impressed to the anode plates 2*b* and 2*c* of the conduction stage 2 by the rectifier 7, so that there occurs a difference in potential between the work 9 and the anode plates 2*b* and 2*c*, and current also flows to the work 9 from the anode plates 2*b* and 2*c* according to the potential difference.

In this instance, in addition to the main electric circuit which is formed through the rectifier 6 →lead wire 6*a*→anode plate 1*b*→paint 4→work 9→collector 10→bus bar 1*a*→lead wire 6*b*→rectifier 6, there is completed a closed current circuit through rectifier 7 →lead wire 7*a*→anode plates 2*b* and 2*c*→paint 4→work 9 →collector 10→bus bar 1*a*→lead wire 6*b*→rectifier 6 →lead wire 8*b*→rectifier 7. Therefore, the work 9 is subjected to electrodeposition coating by the voltage which corresponds to the current flowing from the anode plate 16 and the current from the anode plates 2*b* and 2*c*. The formation of the above-mentioned closed current circuit serves to improve the thickness and thorough electrodeposition of the coating film by increasing the electrodepositing current.

Figure 2:
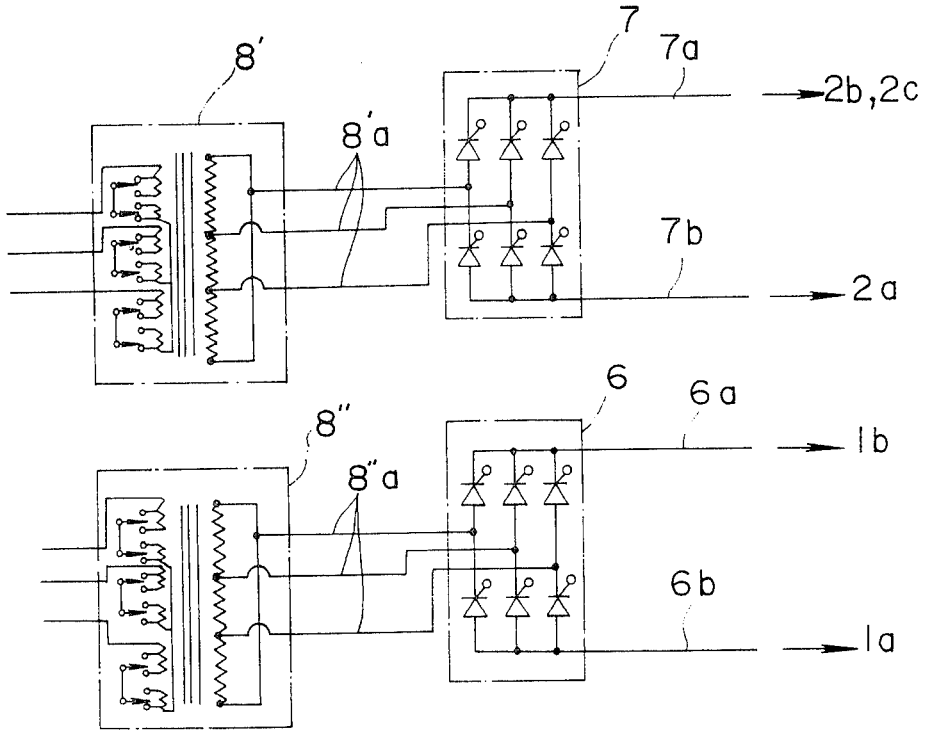
FIG. 2 PRIOR ART
FIG. 2 is a fragmentary circuit diagram showing the relationship between a power transformer and a rectifier in the conventional cationic electrodeposition coating system.

According to the present invention, the closed current circuit is formed by the employment of the system in which a plurality of rectifiers 6 and 7 are connected to a single common AC power transformer 8. In contrast, in a case where the rectifiers 6 and 7 are independently connected to separate AC power transformers 8′ and 8″ as shown in FIG. 2, such a closed current circuit which permits the inflow current from the other conduction stages is not formed. In FIG. 2, the reference numerals 8′*a* and 8″*a* denote connecting lead wires. Thus, with the circuit arrangement as shown in FIG. 2, there occurs no current flow to the work 9 from the anode plates 2*b* and 2*c* of the conduction stage 2, electrodepositing the paint solely by the voltage applied to the conduction stage 1 by the rectifier 6 without the current inflow effect unlike in the present invention.

Figure 3:
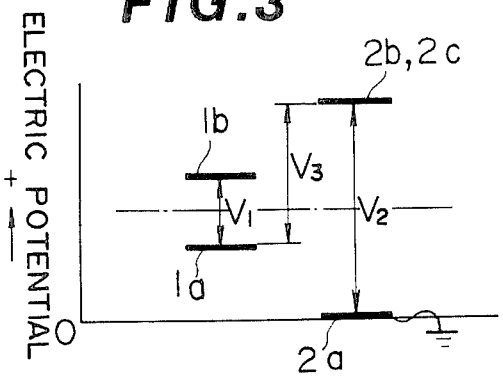
FIG. 3 is a graphic representation of the output voltages of the rectifiers in the embodiment of the present invention.
Figure 4:
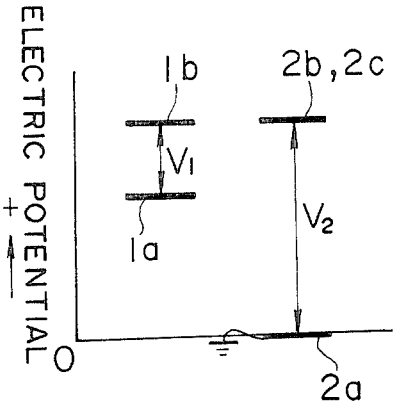
FIG.4 PRIOR ART
FIG. 4 is a graphic representation of the output voltages of the rectifiers in the conventional system.
Figure 5:
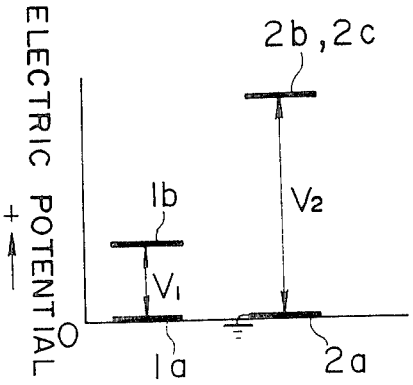
FIG.5 PRIOR ART
FIG. 5 is a graphic representation of the output voltages of the conventional rectifiers in FIG. 4 but in a different state.

Now, reference is made to FIGS. 3 to 5 for the explanation of the relationship between the voltages at the output terminals of the rectifiers 6 and 7 in the above-described electrodeposition coating. FIG. 3 shows the case according to the present invention, in which $V_1$ and $V_2$ are the voltage applied by the conduction stages 1 and 2, respectively. In FIG. 3, the potential of the bus bar 2*a* which is grounded is at the zero level, and the voltage between the work 9 and the anode plates 2*b* and 2*c* is expressed by $V_3$. Therefore, according to the present invention, the work 9 in the conduction stage 1 for application of low voltage is subjected to the electrodeposition by the voltage $V_3$ simultaneously with the electrodeposition by the voltage $V_1$. In contrast, FIGS. 4 and 5 show the output voltages which are applied by the circuit arrangement of FIG. 2, in which the voltages impressed in the conduction stages 1 and 2 are expressed by $V_1$ and $V_2$ respectively. FIG. 4 shows the output voltages when the work 9 is in the conduction stage 1, with the immersed electrodes 1*b*, 2*b* and 2*c* at the same level in potential. FIG. 5 shows the output voltages when the conductor 5 is connected and the work 9 has been transferred to the conduction stage 2. As soon as the conductor 5 is connected and the work 9 is transferred to the conduction stage 2, the potentials of the bus bars 1*a* and 2*a* are held at the same level, and the voltage $V_1$ is shifted to the level of FIG. 5 from that of FIG. 4. As clear from FIGS. 4 and 5, the voltage $V_1$ of the conduction stage 1 and the voltage $V_2$ of the conduction stage 2 are independent of each other, so that the work in the conduction stage 1 is subjected to the electrodeposition coating by the voltage $V_1$ alone.

In the electrodeposition apparatus of FIG. 1, the work 9 is transferred from the bus bar 1*a* to 2*a* in the manner as follows.

As the work 9 which is advanced in the direction of arrow A on and along the bus bar 1 approaches the bus bar 2*a*, the position of the work 9 is detected by a limit switch, a photoelectric tube or other detection means which is not shown, and the conductor 5 is turned on. In this state, the work 9 is further transferred in the direction of arrow A until it gets onto the bus bar 2*a* and this transfer of the work 9 onto the bus bar 2*a* is detected by a limit switch, a photoelectric tube or other detection means which is not shown, whereupon the conductor 5 is turned off to drop the voltage of the conduction stage 1 to zero or low level. In this instance, the voltage of the conduction stage 1 may be dropped to the zero or low level before the conductor is turned on if desired. The work 9 which has been transferred onto the bus bar 2*a* in this manner is subjected to the electrodeposition coating in the conduction stage 2 of high voltage.

The bus bar 2*a* of the high voltage application stage 2 is grounded and therefore maintained at the same potential as the electrodeposition bath 3. It follows that the potential in the electrodeposition bath 3 is at the lowest earth potential, so that there is no possibility of elution of the electrodeposition bath wall even if the lining of the bath wall is broken.

Further, the on-off control of the bus bars 1*a* and 2*a* can be effected safely by the conductor 5 in spite of the difference between the preset output voltages of the conduction stages 1 and 2 since the negative terminal is held in floated state without grounding except the lead wire 7*b* from the negative output terminal of the rectifier 7 of the high voltage application stage. However, in a case where there is a difference between the preset voltages of the conduction stages 1 and 2, one should pay attention to the possibilities of electrodeposition on the anode plate 1*b* of the low voltage application stage due to the potential difference from anode plates 2*b* and 2*c*.

Although the foregoing embodiment is directed to cationic electrodeposition coating by a two-stage conduction system, it is of course possible to apply the present invention to electrodeposition coating processes using more than two voltage application stages. In such cases, current flows to the work from the anode plates of higher voltage application stages in addition to the current of the stage in which the work is currently undergoing the electrodeposition coating. It is also necessary in these cases to ground only the negative output terminal of the rectifier of the highest voltage application stage.

It will be appreciated from the foregoing description that, according to the method and apparatus of electrodeposition coating according to the present invention, the current continuously flows to the work from the anode plates of higher voltages during the electrodeposition coating in each stage except the highest voltage application stage to increase the thickness of the coating film and to attain thorough electrodeposition.

Further, while the current flows to the work from the positive terminals of the rectifiers of the other conduction stages of higher voltage, the output voltage of the rectifier of the conduction stage at which the work is present can be adjusted to minimize the potential difference from the positive terminals of the other stages which supply the inflow current, thereby to improve the quality of the coating film to a significant degree.

The negative terminal of the rectifier of the conduction stage is grounded only in the stage with a highest preset voltage, at the same potential level as the electrodeposition bath, so that the potential in the electrodeposition bath is maintained at the lowest earth potential. Consequently, even if the lining of the electrodeposition bath is damaged for some reason, the electrodeposition bath is maintained at the cathode potential to prevent elution of the electrodeposition bath wall in a secure manner.

The above-described circuit arrangement which has the output terminal of the rectifier held in floated state in each conduction stage except the highest voltage application stage has another advantage that the on-off control of the bus bars of different voltages can be performed safely by a conductor.

In addition, the common use of a single AC power transformer by a plurality of rectifiers can contribute to the reduction of the equipment cost. What is claimed is:

1. A method of electrodeposition coating wherein a work is transferred from a conduction stage of low voltage to a conduction stage of higher voltage among a plurality of conduction stages provided along a path of transfer of a work in an electrodeposition bath, and wherein a plurality of rectifiers are each connected to a bus bar and an anode plate of a respective conduction stage and all of said rectifiers are connected in common to a single power transformer, wherein both the bus bar of the conduction stage of the highest voltage and the electrodeposition bath are grounded, and wherein said bus bars of said conduction stages are disconnectively connected through conductors, said method comprising the steps of:

conducting current, while a work is at a conduction stage of low voltage, to said work from the anode plate of a conduction stage of higher voltage by means of a closed electric circuit formed by the rectifier provided for said conduction stage of higher voltage, the anode plate of the conduction stage of higher voltage, a paint in said electrodeposition bath, said work at said conduction stage of low voltage, the bus bar of said conduction stage of low voltage, the rectifier provided for said conduction stage of low voltage, and the rectifier provided for the conduction stage of higher voltage, as well as conducting current to said work from the anode plate of said conduction stage of low voltage;

connecting the bus bar of the low voltage conduction stage and the bus bar of the next higher voltage conduction stage through the conductor between said low voltage stage bus bar and said next higher voltage stage bus bar to thereby adjust the electric potential of the bus bar of the low voltage conduction stage to be substantially equal to the electric potentential of the next higher voltage conduction stage while maintaining the output voltage of the low voltage conduction stage constant;

transferring said work from said conductions stage of low voltage to said next conduction stage of higher voltage while conducting said current continuously while said work is being transferred;

disconnecting the bus bar of said low voltage conduction stage from the bus bar of said next higher voltage conduction stage by opening said conductor between said bus bar of low voltage and said bus bar of said next higher voltage when said work is completely transferred to said next conduction stage of higher voltage;

conducting a current to said work, while said work is at a conduction stage of the highest voltage, wherein said current which is conducted to said work while said work is at said conduction stage of highest voltage is supplied only from the anode plate of said conduction stage of the highest voltage.

2. A method of electrodeposition coating as set forth in claim 1, wherein voltages of said conduction stages except the conduction stage of the highest voltage are adjustable in the range of from 0 to level to the voltage of said highest voltage of said conduction stage of the highest voltage.

3. A method of electrodeposition coating as set forth in claim 1, wherein said conduction stages consist of at least one conduction stage to which a low voltage is applied and at least one conduction stage to which a high voltage is applied.

4. A method of electrodeposition coating as set forth in any one of claims 1, 2 or 3, wherein said electrodeposition coating is cationic electrodeposition coating.

* * * * *